US007165281B2

(12) United States Patent
Larssson et al.

(10) Patent No.: US 7,165,281 B2
(45) Date of Patent: Jan. 23, 2007

(54) BED

(75) Inventors: Stefan Larssson, Göteborg (SE); David Wyon, Ann Arbor, MI (US)

(73) Assignee: Stjernfjädrar AB, Herrljunga (SE)

( * ) Notice: Subject to any disclaimer, the term of this patent is extended or adjusted under 35 U.S.C. 154(b) by 399 days.

(21) Appl. No.: 10/221,059

(22) PCT Filed: Mar. 9, 2001

(86) PCT No.: PCT/SE01/00496

§ 371 (c)(1),
(2), (4) Date: Sep. 9, 2002

(87) PCT Pub. No.: WO01/65979

PCT Pub. Date: Sep. 13, 2001

(65) Prior Publication Data

US 2003/0019044 A1 Jan. 30, 2003

(51) Int. Cl.
*A47C 21/04* (2006.01)

(52) U.S. Cl. ..... 5/724; 5/726; 5/423

(58) Field of Classification Search ..... 5/724, 5/714, 726, 423, 289, 283
See application file for complete search history.

(56) References Cited

U.S. PATENT DOCUMENTS 1,142,876 A * 6/1915 Davis et al. ..... 5/284
2,462,984 A * 3/1949 Maddison ..... 5/423
2,493,067 A 1/1950 Goldsmith
3,101,488 A 8/1963 Peebles
3,266,064 A 8/1966 Figman
4,185,341 A * 1/1980 Scales ..... 5/699
5,730,120 A * 3/1998 Yonkers, Jr. ..... 128/202.13
5,881,410 A * 3/1999 Yamada ..... 5/713
6,209,335 B1 * 4/2001 Nowaczyk ..... 62/229
6,336,237 B1 * 1/2002 Schmid ..... 5/726

FOREIGN PATENT DOCUMENTS

| | | |
|---|---|---|
| GB | 249760 | 4/1926 |
| GB | 2025764 | 1/1980 |
| SE | 376841 | 6/1975 |
| WO | 99/20157 | 4/1999 |

* cited by examiner

*Primary Examiner*—Patricia Engle
*Assistant Examiner*—Fredrick Conley
(74) *Attorney, Agent, or Firm*—Dilworth & Barrese LLP

(57) ABSTRACT

A bed comprises a support arrangement (1) adapted to provide upper support surfaces for and carry a person lying in the bed through an upper limitation thereof. A suction device is arranged to generate an air flow from the contact surfaces between a person lying in the bed, through the interior of the support arrangement and out thereof for obtaining a ventilation of the bed space under the person and suction of air away from the bed space through the suction device when a person rests in the bed.

24 Claims, 2 Drawing Sheets

BED

FIELD OF THE INVENTION AND PRIOR ART

The present invention relates to a bed comprising a support arrangement adapted to provide upper support surfaces through an upper limitation thereof for and carry a person lying in the bed, in which at least parts of the portions of said upper limitation forming said support surfaces are designed to have a good ability to let air through.

Beds of all types are already known and they have one problem in common, namely the difficulty to create a thermal environment around the person being favourable for the sleeping condition of a person when the person is lying in the bed. The reason for this is that the air on the parts of the support arrangement, normally the mattress of the bed, onto which the person is resting will be heated by the person and a high thermal insulation will be present with respect to the person through the mattress. This means in its turn that the person easily becomes excessively hot and secretion of sweat arises in the body parts bearing against the support arrangement. These circumstances are normally made worser by the fact that the person has a bed quilt over the body for not getting cold on the parts of the body being turned away from the support arrangement. This means that on one hand the sleep of the person in question gets in differently high degrees disturbed and the rest by that not that efficient. On the other, the humid environment formed in the bed next to the upper support surfaces of the support arrangement means that depositions of cuticle from the person in the bed gets moist and soft and perfectly suited as nutrition for mites, which may live and propagate in this environment. The excrements of such mites are strongly allergenic. Another serious problem is that when persons have to stay in the bed for a longer time since they are bound to the bed for different reasons, such as a temporarily or a lengthy disease, unpleasant odours then usually occur from the bed space above the mattress.

It is already known to seek a remedy to these inconveniences in many different ways, such as by arranging different types of fans, such as table fans, spray the bed with mite killing preparations and so on.

SUMMARY OF THE INVENTION

The object of the present invention is to provide a bed which to a large extent finds a remedy to the inconveniences mentioned above of beds already known.

This object is according to the invention obtained by providing a bed in which at least an opening to the exterior is arranged in the support arrangement for communicating with the inner side of the air-permeable parts of said portions, a suction device for creating a negative air pressure is connectable to the opening, and the interior of the support arrangement is adapted to allow a connected suction device in operation to draw the air outside said support surfaces through said air-permeable portion parts and through the interior of the support arrangement out thereof through said opening for drawing air away from said support surfaces through the suction device when a person is resting in the bed.

Through the entirely new approach to suck air from the upper support surfaces for supporting a person resting in the bed through the support arrangement and away through said opening when a person rests, preferably sleeps, in the bed, it gets possible to obtain a thermal comfort for the person resting in the bed of a considerably better type than already known. Through said suction of air away firstly the thermal insulation and the vapour diffusion resistance in the upper part of the support arrangement, normally the mattress, are reduced, so that heat radiated by the body parts in question of the person may be removed with such a speed that the secretion of sweat of the person has not to be started. This means in its turn that the humidity of the air in the bed space above the support surfaces in question may be kept on an acceptably low, normal level, which in its turn means that depositions of cuticle resulting in the bed will get dry and hard and by that inedible to mites, which will experience there living conditions being radically impaired. Thus, the thermal asymmetry of the body of a person resting in the bed is reduced and a more homogenous climate will instead be obtained around the entire body. Accordingly, the invention makes the two most important mechanisms for heat loss more efficient, namely dry heat transport and evaporative heat transport, which both are retarded by conventional bed clothes and mattresses to such an extent that the heat balance of the body of vital importance is made difficult. Another advantageous aspect of the invention is the following: For making it possible to lie comfortable without any need of moving the body it is necessary, except from the thermal climate, that the pressure against the body surface is lower than the blood pressure of the body on each surface unit. If the pressure against the surface exceeds the blood pressure there is a risk that the blood vein will be obstructed and inconveniences occur, which may influence the sleep negatively with body movements as a consequence. A soft bed gets more embracing and increases by that the insulating surface against the body. For being able to solve this problem material as horsehair, pighair, peat, wool, hay, flax, etc are used as material in the beds of today. These materials may absorb moisture and transport the moisture downwardly in the bed (humid air is lighter than dry one) and by that increase the thermal comfort. However, by utilising the principal according to the invention the bed may be manufactured with simple, less costly synthetical and hygienical material and also be made with still better properties than possible with the absorbing materials of today and with a better thermal comfort.

According to a preferred embodiment of the invention the air-permeable portion parts are surrounded by an air-tight material for concentrating the flows of air from the region of said support surfaces through said portion parts, and at least parts of the interior of the support arrangement are air-tightly delimited with respect to the exterior for only allowing communication with the exterior through said opening and said portion parts. The suction capacity of the suction device gets by this efficient exactly were this is needed, so that the suction power required for a given amount of air transported away per time unit from the region of the contact surfaces between a person resting in the bed and the bed gets low and by that energy for driving the suction device may be saved, but this may primarily be dimensioned to work comparatively quite, which of course is desired when the person in the bed wants to sleep, especially if the suction device is arranged close to the support arrangement.

For increasing the efficiency of the suction device further the air-permeable portion parts do preferably constitute a restricted region of the upper limitation of the support arrangement, which substantially corresponds to the support surfaces being adapted to receive and support any body part of a person lying in the bed, and more exactly is said region restricted to the support surfaces being adapted to receive and support the thighs and the trunk of a person lying in the bed. The heat generated and emitted by the person mainly comes from these large body parts, so that it may be suitable to restrict the suction of air to the contact surface these have to the support arrangement.

According to other preferred embodiments of the invention the air-permeability is obtained by arranging through-holes through a substantially air-tight material layer, or by arranging a layer of a material having a good capacity to let air through.

According to another preferred embodiment of the invention the suction device comprises a fan member arranged in a room on the lower side of the support arrangement, and the bed comprises a box delimiting said room for receiving the fan member and provided with silencing members. This is advantageous for not disturbing the person resting in the bed by the operation of the fan member.

According to another preferred embodiment of the invention the suction device is connected to said opening through a conduit leading to a fan member included in the suction device and remotely arranged with respect to the support arrangement. Both increased possibilities to shield noise generated through the operation of the fan member from the person lying in the bed and to blow out the air sucked away by the fan at a proper distance to the bed are obtained, so that bad body smell and moisture may be removed from the room in which the bed is located.

According to another preferred embodiment of the invention the bed comprises members adapted to measure the temperature of the air located in immediate proximity to said support surfaces of the support arrangement and send information thereabout to the control unit, and the control unit is adapted to control the suction of air of the suction device in dependence of said temperature information. An adjustment of the temperature of the air surrounding the body of the person in contact with said support surfaces being an optimum for the comfort of the person lying in the bed is enabled by this. By the fact that according to another preferred embodiment of the invention the bed has members adapted to measure the humidity of the air located in immediate proximity to said support surfaces of the support arrangement and send information thereabout to the control unit, and the control unit is adapted to control the suction of air of the suction device in dependence of said air humidity information, it may continuously be ensured that the air humidity of the air surrounding the body of a person resting on the support arrangement is kept on a desired level. Especially these two members in combination with each other may enable a desired adjustment of the thermal environment for the person lying in the bed.

According to another preferred embodiment of the invention the suction device is arranged reversable, and the control unit is adapted to be able to control the suction device to be reversed for blowing air in through said opening and out through said portion parts of the support surfaces of the support arrangement. A heating element is then preferably at the same time arranged to heat the air so supplied to the region of said contact surfaces, in which this may mainly be utilised before the person in question shall lay down in the bed for heating this to a level experienced as pleasant by the person when this goes to bed.

It is well possible that the control unit is designed to automatically control the suction device and parts of the bed cooperating therewith in dependence of predetermined criterions, in which different types of detectors, such as attendance detectors and the like, may be arranged for influencing the control, but it would also be well possible that as an option provide the possibility of a control by hand of parts included in the bed, at least the suction device, by arranging means therefor.

Further advantages as well as advantageous features of the invention will appear from the following description and the other dependent claims.

BRIEF DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
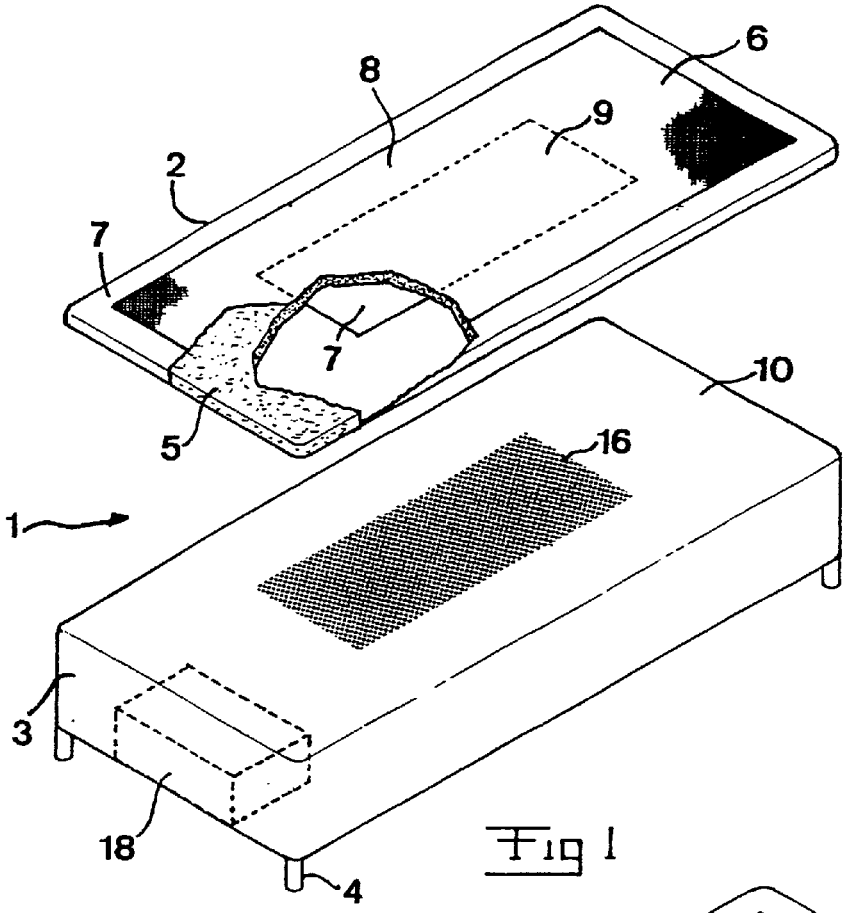
FIG. 1 is a simplified, partially exploded, and sectioned view of a bed according to the invention.
Figure 2:
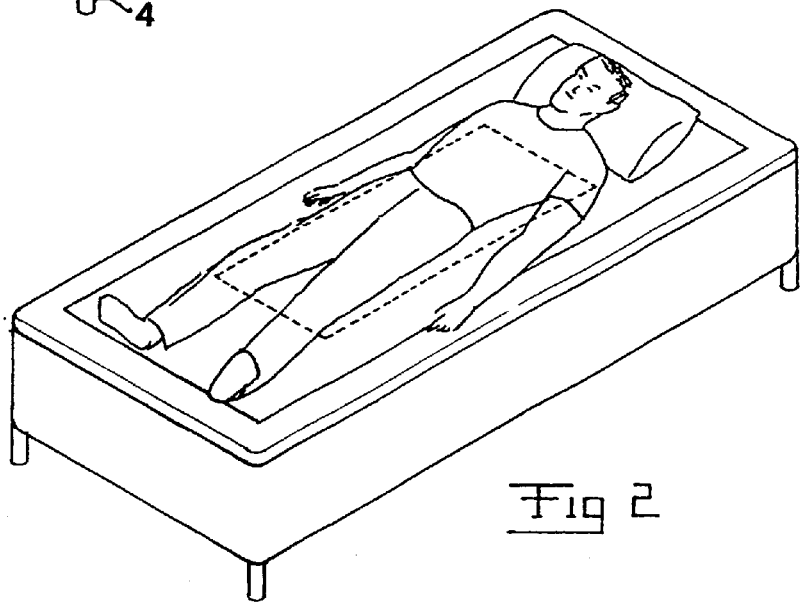
FIG. 2 illustrates schematically the bed according to FIG. 1 with a person resting thereon.
Figure 3:
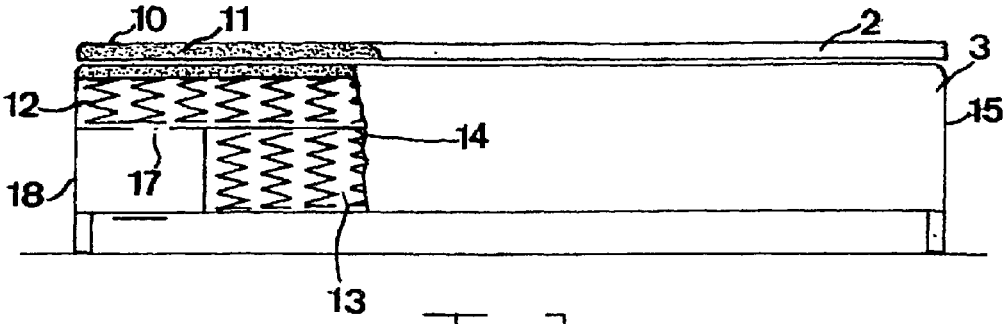
FIG. 3 is a sectioned side-elevation of a bed according to a preferred embodiment of the invention.

The construction of a bed according to a preferred embodiment of the invention will now be described while making reference simultaneously to FIGS. 1–3. The bed has in a conventional way a support arrangement 1 adapted to support a person lying in the bed and which is formed by a mattress 2 and a bed part 3, which sometimes is called bed and is provided with legs 4 for standing on the floor. The mattress 2 has in the present case a core layer 5 of an elastic soft material with a good ability to let air through, such as perforated latex. This core layer 5 is covered by a thin cover layer 6 of an elastic soft cover material being air-permeable, for example a textile of the type wool tricot. Finally, the mattress has a circumferential frame 7 of an elastic, soft and airtight material, which on the lower side extends further in towards the centre of the mattress than on the upper side of the mattress. This frame 7 restricts on the top a surface 8 through which air may enter the bed mattress from above and a lower more restricted surface 9, through which air may move between the interior of the bed mattress and the space under the bed mattress. The idea behind the appearance will be explained further below.

The bed part 3 is constructed in the following way: A thin covering layer 10 of an elastic, soft and air-tight material is arranged on the top, for example the same material as the layer 7 of the mattress, such as fabric with an impermeable layer of polyurethane. An elastic, very air-permeable thicker layer 11, for example of any foamed plastic, is arranged thereunder. Under this different types of spring members 12 are arranged in a room 13 occupying the main part of the inner volume of the bed part. The spring members are arranged to give the person lying in the bed a support when lying in the bed being suitable from the anatomic point of view. The spring members are in the present case formed by helical springs arranged in so-called double spring packages with support members 14 located between the packages. The room 13 is laterally and at the bottom air-tightly delimited with respect to the exterior through a surrounding tight member 15.

Figure 4:
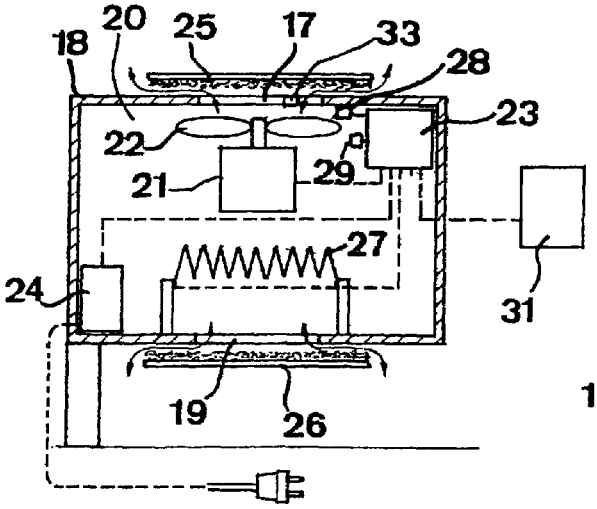
FIG. 4 is a detailed view of a part of the bed according to FIG. 3 in side-elevation.

The inner room 13 in the bed part is permitted to communicate through air exchange with the surroundings at two locations. The first is formed at the top by arrangement of small through-holes 16 in the air-tight material layer 10, and-these holes are arranged along a surface substantially corresponding to the surface 9 of the lower side of the bed mattress. The second location is formed by an opening 17 in the tight member 15 arranged on the lower side of the bed part at the foot end of the bed. Reference will now also be made to FIG. 4. The opening 17 opens into a box 18 arranged under the bed part and which is at the bottom provided with a second opening 19 for communicating with the exterior of the bed. A fan member 20 in the form of an electric motor 21 and a propeller 22 driven thereby to rotate are arranged in the interior of the box with the propeller close to the opening 17. A control unit 23 is arranged to control the function of the fan member and energy supply is received from the electricity network through an energy supply device 24. Both openings 17 and 19 are partially obstructed by covering members 25 and 26, respectively, with the aim to absorb-noise.

When the fan member is driven in such a way that it generates a negative air pressure at the opening 17 air will be drawn through the upper surface 8 of the bed mattress, mainly through the central parts thereof corresponding to a projection of the lower surface 9 thereof, through the bed mattress, out on the lower side thereof through the surface 9, through the perforations 16 of the upper layer 10 of the bed part, into the inner volume of the bed part, through the spring package and out through the opening 17 for then being blown out of the box through the opening 19. However, would it be possible to reverse the suction device air may instead be blown in the opposite direction. Such reversing may take place by arranging the fan member reversable for by turning the air flow generated through a suitable valve device. A heating element 27 is arranged inside the box for upon need heat the air transported to the region above the mattress when the fan member is reversed. The control unit 23 may preferably, except from regulating the switching on and off of the heating element, adjust the inblow temperature, possibly by means of the speed of the fan.

The bed has also members 28 adapted to measure the temperature of the air for the moment located immediately above the support surfaces formed by the mattress for a person lying in the bed, in which this is preferably made indirectly through a member 28 arranged close to the opening 17 for measuring the temperature of the air sucked out therethrough. Members 29 measuring the humidity of the air above said support surface are also arranged, here also for indirect measurement close to the opening 17. These members 28, 29 are adapted to send information about the temperature and air humidity, respectively, prevailing to the control unit 23, and this is in its turn adapted to control the fan member 20 in dependence of this information and predetermined criterions, which do not necessarily have to mean constant levels of temperature and air humidity over a given period of time. Furthermore, a means for controlling at least the fan member, but possibly also the heating element, by hand in the form of a control 31 is arranged accessible to the person lying in the bed.

The temperature measuring member 28 could also be placed outside the very fan box 18 and for example be located in the control 31 which may be connected to a spiral cord and as mentioned be placed easily accessible to the user, for example on a bedside table. It would also be conceivable to have two temperature measuring members, one in the box 18 and one outside thereof as just described. The corresponding reasoning is valid for the air humidity measuring member 29, i.e. in the box 18, outside the box, for example in the control 31, or both. By placing the measuring members 28, 29 in the way mentioned outside the box an adaption of the bed to different outer conditions is enabled, such as lowering of the temperature in the night or using the bed in regions with different climates and typically temperatures and moisture levels within widely different value ranges.

The function of the bed is the following: When a person (schematically indicated in FIG. 2) lies in the bed and rests, preferably sleeps, this will bear through about 35% of the body surface against the support arrangement and the main part thereof against the support surface portion of the support arrangement corresponding to a projection of the surface 9 of the mattress. This surface is preferably dimensioned to receive and support the thighs and the trunk of a person lying in the bed and the surface 9 has for this sake preferably a length of between 0.8 and 1.3 m and a width of between 0.4 and 0.7 m. The length is 1 m and the width 0.5 m in the present case. When the fan member is switched off the bed and the bed clothes will together form a considerable thermal insulation with standing air in combination with a high vapour diffusion resistance, which has a tendency to initiate secretion of sweat from the person and by making the evaporation and diffusion of sweat difficult form a humid and warm environment around the body of the person supported by the mattress. If now instead the fan member is controlled to draw air through the mattress and in the way described above to the opening 17, the thermal insulation and the vapour diffusion resistance in the mattress will decrease drastically, so that the thermal asymmetry over the body will substantially disappear and a more homogenous climate with an acceptable air humidity and temperature may be obtained around the entire body of the person lying in the bed. The thermal conditions for the person get by this substantially as if this would stand upright with a bed quilt loose around the body. The suction device, i.e. the fan member, may then be controlled so that the suction capacity thereof is adapted to the values measured for different parameters, such as temperature and air humidity, of the air at the contact surfaces between the person and the bed. There is also a possibility for the person to influence the function of the fan member by hand through the control 31, and it would also be possible to provide the control or the control unit with a timer for setting varying suction during different periods of time of the day. There is of course also a possibility to now and then just turn the fan member off. A ventilation of the bed space above the lying surface with an environment being substantially improved for a person lying in the bed but remarkably deteriorated for the living conditions for mites, which lives through depositions of cuticle, which through the lack of humidity gets so hard that they may not function as nutrition for the mites, is obtained through the construction of the bed according to the invention.

It would also be possible to use the bed according the invention in such a way that the lying surface gets heated until a person is to lay down in the bed by reversing the air flow and switch in the heating element 27, so that the function then will be similar to a warm water bottle. Energy may by this in certain cases be saved by the fact that a lower room temperature may be accepted without waiving the well being of the person. The air could through the heating element 27 be given a temperature of about 40° C. measured in the member 28.

It would of course also be possible to let the function of the fan member and possibly also the heating element be controlled in dependence of different detectors, such as attendance detectors, so that for example a suction is started as soon as a person lays down in the bed and ceases when the load is removed from the lying surface of the bed. It is in FIG. 4 also illustrated that a pressure sensor 33 is adapted to detect the movements of a person and enable a good regulation of the thermal climate.

Figure 5:
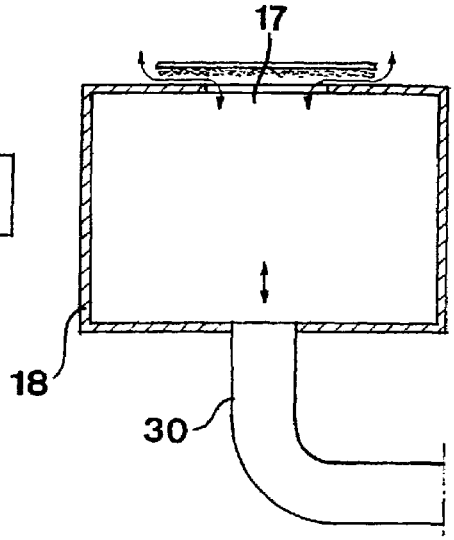
FIG. 5 illustrates schematically how the air sucked away may be transported away from the bed through a conduit according to a preferred embodiment of the invention.

It is shown in FIG. 5 how it is possible to only connect a conduit 30, here in the form of a hose, with the opening 17 to the inner space of the bed part and arrange the fan member remotely located, for example in another room than the bed, for obtaining on one hand a minimum of disturbances of the person lying in the bed through the fan member, and on the other for ensuring that the air, which may be rotten and smell badly, sucked out from the region of the lying surface of the bed will not come out into the room in which the bed is located but for example is blown out in the open air. Another possibility to remove particles and bad body air from air blown out by the fan member in a flat consists in arranging a particle filter provided with a carbon filter part adapted to absorb odourants in the exhaust air.

Figure 6:
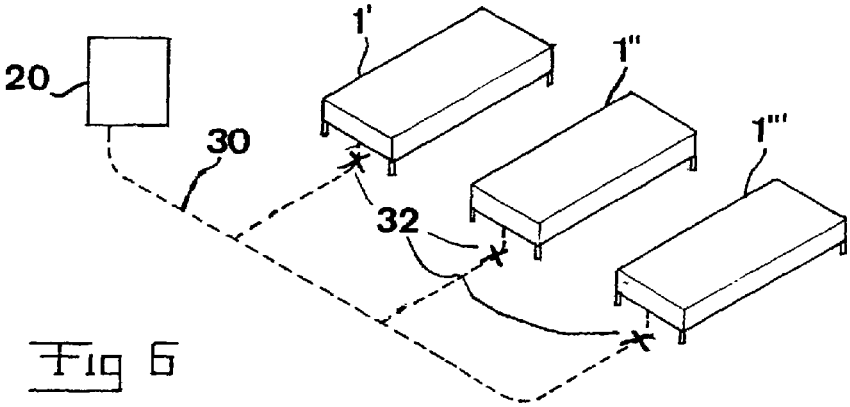
FIG. 6 illustrates schematically how a plurality of beds may be connected to one single remotely located suction device in common.

A further development of the embodiment just described is shown in FIG. 6, in which conduits from a plurality of beds 1', 1", 1''' are connected to a fan member 20 in common, which may be advantageous in for example nursing homes and hospitals. It is in this case suitable to have a throttle valve 32 indicated in FIG. 6 on the respective bed. It would also be possible to utilise a central vacuum cleaner system as suction device.

The invention is of course not in any way restricted to the preferred embodiments described above, but many possibilities to modifications thereof would be apparent for a man with skill in the art without departing from the basic idea of the invention as defined in the appended claims.

It would for example be possible to have the mattress and the bed part integrated into one single unit, and the air-tight part 7 will then in the practise not reach in on the lower side of the mattress, but this part will connect peripherally directly to the sealing member 15 so as to delimit the space within the unit so formed. This will result in a need of a lower power of the fan member for obtaining a determined air flow velocity.

It would of course be possible to let the fan member operate continuously around the clock with exactly the same speed and a low air flow and then possibly totally omit the control unit, but it would also be possible to connect more detecting members than those discussed above to the control unit for making the function of the fan member dependent upon the value of the parameters detected by these members. Such a detector could for example be adapted to detect the temperature in the room in which the bed is located, since there may for example be a need of a stronger air flow in the summer when the temperatures in the room are high.

It is pointed out that the bed may just as well be a twin bed, although it is above all the time spoken about one person resting in the bed. It would then in the practise also be possible to design the support arrangement for one person in the way described above, while the other bed half corresponds to a conventional bed, although this is hardly not desired. It would also be conceivable to provide a possibility to individual control of the climate in the proximity of the respective bed half.

The invention claimed is:

1. A bed, comprising a support arrangement (1,2,3) having an upper support surface (8) structured and arranged to support an individual lying thereon, at least a portion (5,6) of said upper support surface (8) being permeable to air, an opening (17) arranged through said support arrangement (1,2,3) to exterior surroundings and communicating with said at least air permeable portion (5,6) through an interior (13) of said support arrangement (1,2,3), a suction device (20) for creating negative air pressure being connectable to said opening (17), such that air is drawn from the exterior surroundings through said at least air permeable portion (5,6) and said interior (13) of said support arrangement (1,2,3) and out through said opening (17), to thereby draw air away from said support surface (8) through said interior (13) when the individual is lying on the bed, and means for controlling temperature surrounding an individual lying upon the bed by solely controlling the suctioning of air and comprising a control unit (23, 31) connected to said suction device (20) for controlling the drawing of air through said interior (13) of said support arrangement (1,3), members (28) structured and arranged for measuring temperature of air located in immediate proximity to said support surface (8) of said support arrangement (1,2,3) and coupled to said control unit (23) to forward temperature measurement thereto, such that said control unit (23) controls operation of said suction device (20) depending upon the measured temperature and controls temperature of air surrounding the individual lying upon the bed in the absence of further heating/cooling means.

2. The bed of claim 1, additionally comprising an air-tight material (7) surrounding said at least air permeable portion (5,6) and being structured and arranged to concentrate flow of air from an area of said support surface (8) through said at least air permeable part (5,6), and said support arrangement (1, 2, 3) air-tightly delimiting the interior thereof to only permit air flow therethrough (13) between said at least air permeable portion (5, 6) and opening (17).

3. The bed of claim 1, wherein said at least air permeable part (5, 6) comprises a restricted region (9) essentially corresponding to a portion of said support surface (8) structured and arranged to receive any body part of an individual lying thereon.

4. The bed of claim 3, wherein said restricted region (9) is structured and arranged to support thighs and a trunk of an individual lying thereon.

5. The bed of claim 3, wherein said restricted region (9) is substantially centered in said support surface (8) and has a length, in a longitudinal direction of the bed, of between 0.8 and 1.3 m.

6. The bed of claim 3, wherein said restricted region (9) is substantially centered in said support surface (8) and has a width, in a transverse direction of the bed, of between 0.4 and 0.7 m.

7. The bed of claim 1, additionally comprising a group of spring members (12) arranged in the interior (13) of said support arrangement (1, 2, 3) such that air drawn by said suction device (20) through said at least air permeable portion (5,6,9) and said opening (17) passes through said group of spring members (12).

8. The bed of claim 1, wherein said support arrangement (1, 2, 3) comprises a mattress (2) and a separate support part (3) structured and arranged to carry the mattress (2) thereon, said mattress comprising said at least air permeable portion (5,6) and said separate support part (3) also comprising an air permeable portion (16) surrounded by air-tight boundries (10, 15) and arranged for communicating the interior (13) of the support part (3) with said mattress (2).

9. The bed of claim 1, wherein said support arrangement comprises an integral mattress and support part with the entire support arrangement (1, 2, 3) surrounded by air-tight boundaries which are perforated by said opening (17) and at least air permeable portion (5,6).

10. The bed of claim 1, wherein said air permeable portion (5, 6) comprises through-holes (16) arranged through substantially air-tight material constituting the upper surface (10) of said support arrangement (1,3).

11. The bed of claim 1, wherein said air at least permeable portion (5, 6) is constituted by a layer of material having good air permeability.

12. The bed of claim 1, wherein said opening (17) is arranged on a lower side of the support arrangement (1, 2, 3).

13. A bed, comprising a support arrangement (1,2,3) having an upper support surface (8) structured and arranged to support an individual lying thereon, at least a portion (5,6) of said upper support surface (8) being permeable to air, an opening (17) arranged through said support arrangement (1,2,3) to exterior surroundings and communicating with said at least air permeable portion (5,6) through an interior (13) of said support arrangement (1,2,3), a suction device (20) for creating negative air pressure being connectable to said opening (17), such that air is drawn from the exterior surroundings through said at least air permeable portion (5,6) and said interior (13) of said support arrangement (1,2,3) and out through said opening (17), to thereby draw air away from said support surface (8) through said interior (13) when the individual is lying on the bed, a control unit (23, 31) connected to said suction device (20) for controlling the drawing of air through said interior (13) of said support arrangement (1,3), members (28) structured and arranged for measuring temperature of air located in immediate proximity to said support surface (8) of said support arrangement (1,2,3) and coupled to said control unit (23) to forward temperature measurement thereto, such that said control unit (23) controls operation of said suction device (20) depending upon the measured temperature and controls temperature of air surrounding the individual lying upon the bed, additionally comprising a separate compartment (18) situated within the interior (13) of the support arrangement (1,2,3) on a lower side thereof and with said opening (17) situated through a wall of said compartment (18), and said suction device (20) is constituted by a fan member (22) situated within said compartment (18).

14. The bed of claim 13, additionally comprising a baffle (25, 26) arranged for partially obstructing said opening (17) to dampen noise.

15. The bed of claim 1, additionally comprising a conduit (30) coupled with said suction device (20) through said opening (17) such that said suction device (20) comprises a fan member (22) remotely located from said support arrangement (1, 2, 3).

16. The bed of claim 15, comprising a plurality of separate support arrangements (1', 1", 1'") coupled with said suction device (20) through said conduit (30) such that a single fan member (22) ventilates support surfaces of said plurality of support arrangements (1', 1", 1'").

17. A bed, comprising a support arrangement (1,2,3) having an upper support surface (8) structured and arranged to support an individual lying thereon, at least a portion (5,6) of said upper support surface (8) being permeable to air, an opening (17) arranged through said support arrangement (1,2,3) to exterior surroundings and communicating with said at least air permeable portion (5,6) through an interior (13) of said support arrangement (1,2,3), a suction device (20) for creating negative air pressure being connectable to said opening (17), such that air is drawn from the exterior surroundings through said at least air permeable portion (5,6) and said interior (13) of said support arrangement (1,2,3) and out through said opening (17), to thereby draw air away from said support surface (8) through said interior (13) when the individual is lying on the bed, a control unit (23, 31) connected to said suction device (20) for controlling the drawing of air through said interior (13) of said support arrangement (1,3), members (28) structured and arranged for measuring temperature of air located in immediate proximity to said support surface (8) of said support arrangement (1,2,3) and coupled to said control unit (23) to forward temperature measurement thereto, such that said control unit (23) controls operation of said suction device (20) depending upon the measured temperature and controls temperature of air surrounding the individual lying upon the bed, additionally comprising members (29) structured and arranged for measuring humidity of air located in immediate proximity to said support surface (8) and coupled to the control unit (23) to forward the measurement thereto such that the control unit (23) controls the suction device based upon the measured humidity.

18. The bed of claim 17, wherein said temperature and humidity measuring members (28, 29) are structured and arranged to indirectly measure the temperature and humidity by sensing air drawn by said suction device (20) through said at least air permeable portion (5,6) of the upper surface (8) of the support arrangement (1, 2, 3).

19. The bed of claim 1, wherein said control device (23, 31) is structured and arranged to reverse operation of said suction device (20) for inspiring air into said interior (13) through said opening (17) and out through said at least air permeable portion (5,6) of said upper support surface (8).

20. The bed of claim 19, additionally comprising a heating element (27) structured and arranged to heat the inspired air when said suction device (20) is reversed by said control element (23), to thereby supply heated air immediately above the upper support surface (8).

21. The bed of claim 1, wherein said control device (23, 31) comprises a hand control (31) for said suction device (20).

22. A bed, comprising a support arrangement (1,2,3) having an upper support surface (8) structured and arranged to support an individual lying thereon, at least a portion (5,6) of said upper support surface (8) being permeable to air, an opening (17) arranged through said support arrangement (1,2,3) to exterior surroundings and communicating with said at least air permeable portion (5,6) through an interior (13) of said support arrangement (1,2,3), a suction device (20) for creating negative air pressure being connectable to said opening (17), such that air is drawn from the exterior surroundings through said at least air permeable portion (5,6) and said interior (13) of said support arrangement (1,2,3) and out through said opening (17), to thereby draw air away from said support surface (8) through said interior (13) when the individual is lying on the bed, a control unit (23, 31) connected to said suction device (20) for controlling the drawing of air through said interior (13) of said support arrangement (1,3), members (28) structured and arranged for measuring temperature of air located in immediate proximity to said support surface (8) of said support arrangement (1,2,3) and coupled to said control unit (23) to forward temperature measurement thereto, such that said control unit (23) controls operation of said suction device (20) depending upon the measured temperature and controls temperature of air surrounding the individual lying upon the bed, additionally comprising an air-tight box (18) situated upon a bottom interior surface of said support structure (1,2,3), with said opening (17) being situated through a top wall of said box structure (18), said suction device (20) constituted by a fan with impeller (22) situated withing said box structured (18), and a second opening (19) situated through a bottom surface of said box structure (18) to the exterior surroundings.

23. The bed of claim 22, additionally comprising covers (25,26) partially obstructing said openings (17, 19) to dampen noise, a heating element (27) situated within said box structure (18), two groups of springs (12) arranged within said interior (13) of said support arrangement (1, 2, 3) with a support member (14) interposed vertically between said two groups of springs (12), and a mattress (2) structured and arranged to be carried by said support arrangement (1,3) and having an air-permeable core layer (5), an air-tight frame (7) surrounding said core layer (5), and a cover layer (6) defining said at least air-permeable portion (9) through said top surface (8) and surrounded by said frame (7).

24. The bed of claim 1, wherein said members (28) are arranged close to said opening (17) to measure temperature of the air suctioned therethrough.

* * * * *